United States Patent [19]

Carithers, Jr.

[11] Patent Number: 4,878,409

[45] Date of Patent: Nov. 7, 1989

[54] CIRCULAR MAT CUTTING APPARATUS

[76] Inventor: Charles H. Carithers, Jr., 5752A Gallant Dr., Jackson, Miss. 39236

[21] Appl. No.: 143,047

[22] Filed: Jan. 12, 1988

[51] Int. Cl.[4] ..... B26D 5/08; B26D 7/02

[52] U.S. Cl. ..... 83/466; 83/468; 83/522.15; 83/564; 83/588; 83/591; 83/647.5; 83/826; 83/829; 33/27.01; 33/27.04

[58] Field of Search ..... 83/490, 582, 588, 591, 83/647.5, 821, 826, 829, 455, 468, 483, 456, 452, 454, 464, 522, 523, 371, 390, 466; 33/27.01, 27.04, 27.11; 30/300, 310

[56] References Cited

U.S. PATENT DOCUMENTS

| | | | |
|---|---|---|---|
| 766,158 | 7/1904 | Starr | 83/591 |
| 2,512,786 | 6/1950 | Borg | 33/27.01 |
| 3,429,042 | 2/1969 | Lawrence et al. | 83/456 |
| 4,112,793 | 9/1978 | Pierce | 33/31 |
| 4,530,156 | 7/1985 | Kettlestrings | 33/27.01 |
| 4,624,057 | 11/1986 | Hursey | 33/27.01 |

OTHER PUBLICATIONS

Oval -Circle Cutter Ad -1983.

Oval-Master -Reference Parts -1983.

*Primary Examiner*—Frank T. Yost
*Assistant Examiner*—Rinaldi Rada
*Attorney, Agent, or Firm*—Larson and Taylor

[57] ABSTRACT

An apparatus for cutting circular arcs or holes in a picture mat includes a flat base upon which the mat rests and a platform provided above the base . A disc member is suitably mounted for rotation adjacent the platform about a center axis. A crank mechanism having a axle extending perpendicularly through the disc member and a mounting arm attached to an extending perpendicular arm from the end of the axle are provided on the disc member. This crank mechanism is slidably mounted to the disc member. A cutting blade is then adjustable mounted along the mounting arm and at an angle to the mat. The circles or arcs are cut in the mat by rotation of the crank mechanism—at a location determined by the position of the crank mechanism and of the disc member, and with a diameter determined by the position of the cutting blade relative to the mounting arm.

25 Claims, 3 Drawing Sheets

CIRCULAR MAT CUTTING APPARATUS

FIELD OF THE INVENTION

The present invention relates generally to an apparatus for cutting a picture mat or the like, and more particularly to an apparatus for cutting a series of circular arcs or holes in a picture mat.

BACKGROUND OF THE INVENTION

When it has been desired to cut a series of holes in a picture mat, this has generally required a laborious and time consuming manual effort. Such efforts are prone to miscalculations or mismarkings which can ruin the job.

In order to cut ovals in picture mats, there has been disclosed in the prior art an Oval-Master apparatus manufactured by C&H Manfacturing of Jackson, Miss. This device was adjustable to cut ovals of various sizes and of ovalities including plane circles as well. Using a suitable movable guide on a base, the picture mat was suitably located beneath a center of the cutting apparatus. The cutting apparatus was mounted to a platform which was lowerable into position to engage the mat during cutting. While this apparatus was advantageous for cutting ovals and circles in mats, in order to cut a plurality of such ovals and circles in a mat, the mat had to be continually repositioned at precise locations determined by x and y scales on the base.

SUMMARY OF THE INVENTION

In accordance with the present invention, an apparatus for cutting circular arcs or holes in a picture mat includes a flat base upon which the mat rests and a platform provided above the base. A cutting means for cutting the mat includes a disc member and a disc mounting means for mounting the disc member for rotation adjacent the platform about a center axis. A crank mechanism has an axle extending perpendicularly through the disc and a mounting arm attached to and extending perpendicular from a bottom end of the axial below the disc which is mounted slidably by a crank mounting means to the disc. A cutting blade is mounted by a blade mounting means for adjustment along the mounting arm and at an angle to the mat. The circular arc is cut in the mat by rotation of the crank mechanism at a location determined by the position of the crank mounting means and the disc mounting means, and with the diameter determined by the position of the blade mounting means.

In a preferred embodiment of the present invention, a disc locking means is provided for releasably locking the disc member in place relative to the platform. In addition, spacing indicia is provided on the platform about the disc member and an indicator on the disc member is selectively alignable with this indicia. By use of this indicia, a selective plurality of evenly-spaced circles are cut in the mat about the center axis by making a cut each time the indicator is selectively spaced in alignment with each corresponding indicia by rotation of the disc member. The disc mounting means preferably mounts the disc member in a plane of the platform so that the indicator extends from the disc member over the platform and includes an aperture therein. The disc locking means then includes a plurality of holes in the disc member at preselected positions adjacent the indicia and a pin which is inserted through the aperture in the indicator and one of the holes in the disc member. The disc mounting means preferably also includes at least three bridging members and a low friction member.

In the preferred embodiment, an axle indicating means is also provided for indicating the distance of the axle from the center axis. In addition, the crank mounting means preferably includes a slot provided in the disc member, a bearing member which slides in the slot and in which the axle is rotatably mounted, and a crank locking means for locking the bearing member in the selected position along the slot. The slot is radially directed so that the axle indicating means includes an indicator on the bearing member and indicia adjacent the radial slot on the disc member. The crank member includes a resilient biasing means for biasing the axle upwards so that the blade is raised out of engagement with the mat until the operator exerts a force to overcome the biasing means and cause the blade to pierce the mat. This crank mechanmism also includes a crank arm attached to a top of the axle and a sliding mounting of the bearing member which is spring loaded to act as a resilient biasing means against which spring the crank arm is pushed to engage the blade.

According to the preferred embodiment, the blade mounting means includes a blade indicating means for indicating a distance between a center of the axle and the cutting blade in order to determine the diameter or radius of the circle to be cut. This blade mounting means includes a slide member which slides along the mounting arm and indicia located along the mounting arm as well as an indicator on the slide member. This slide member is also selectively lockable in position by a suitable blade locking means.

Preferably, a base indicating means is also provided for indicating a position of the center axis along two perpendicular directions in the plane of the base. With this base indicating means, the mat is easily centered about the center axis prior to cutting. The base indicating means includes a first rule member provided on the base and a second rule member which is slidably mounted by a rule mounting means to the first rule member. The second rule member is selectively lockable in place by a suitable lock means on the first rule member. A stop member is also movably mounted on the second rule member.

The blade mounting means preferably includes a blade holding means for holding the cutting blade thereto, a rod to which the blade holding means is attached so that the cutting blade is offset from the rod, and a receiving means for removably receiving the rod and for allowing free rotation of the rod. With this construction, the cutting blade tracks at the proper position when cutting.

A platform mounting means is also preferably provided for mounting a side of the platform pivotally to a side of the base. Thus, the platform is easily moved between a non working raised position away from the base and a working lowered position adjacent the base. A holding means is further provided for holding the platform in the raised position. This holding means includes a stop member provided adjacent one of the platform and the base, a stop lever pivotally mounted to the other of the platform or the base, and a biasing means for biasing the stop lever into position to engage the stop member and thus to hold the platform in the raised position when the platform is raised. A mat holding means is also preferably provided to hold the mat against the base when the platform is in the lowered position and for disengaging from the mat when the patform is in the raised position.

For convenience, the disc is preferably made of a transparent material. In addition, the platform is also made of a transparent material.

It is an object of the present invention to provide a mat cutting apparatus whereby a plurality of circles or arcs are cut in the mat at equally spaced locations about the center axis.

It is also an object of an the present invention to provide a mat cutting apparatus which is easily operated and convenient to use.

Other features and objects of the present invention are stated in or apparent from a detailed description of a presently preferred embodiment of the invention found herein below.

DETAILED DESCRIPTION OF THE PREFERRED EMBODIMENT

Figure 1:
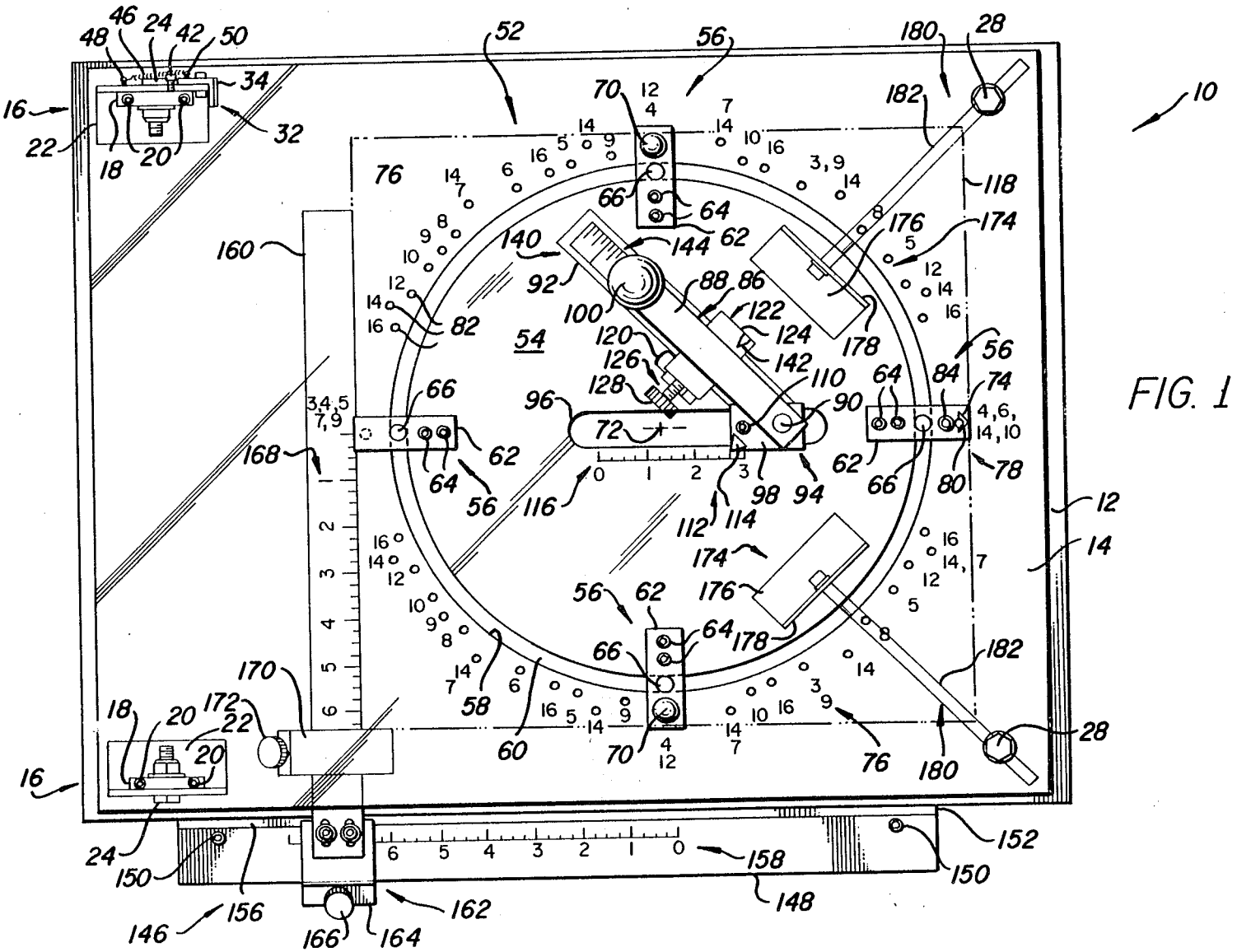
FIG. 1 is a top plan view of a circular mat cutting apparatus according to the present invention.
Figures 2, 3:
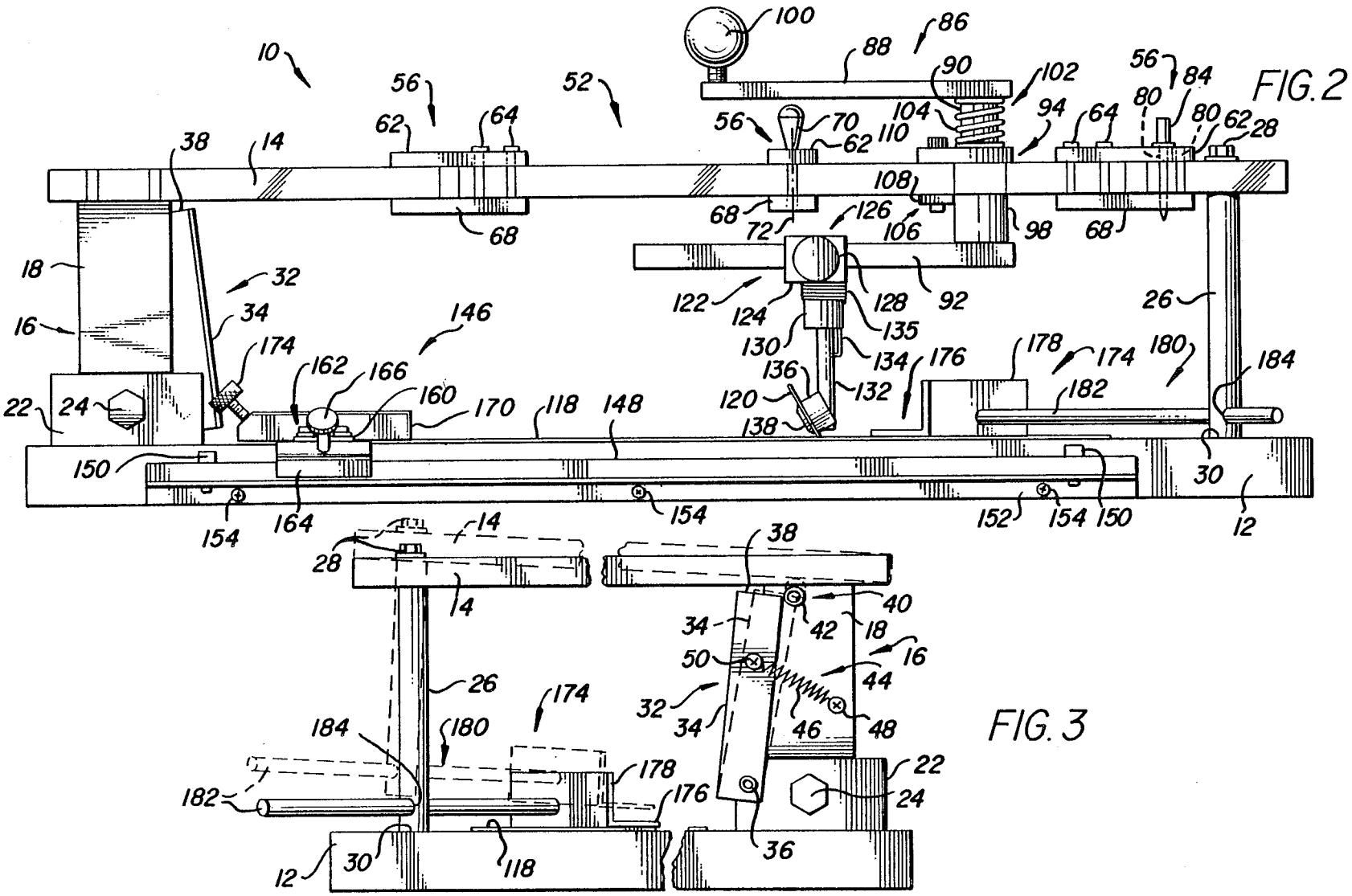
FIG. 2 is a front elevation view of the mat cutting apparatus depicted in FIG. 1.
FIG. 3 is a schematic back elevation view of the mat cutting apparatus depicted in FIG. 1 and showing the platform holding means.

With reference now to the drawings in which like numerals represent like elements throughout the several views, a mat cutting apparatus 10 is depicted in FIGS. 1–3 according to the present invention. Mat cutting apparatus 10 includes a base 12 and a platform 14. As shown best in FIGS. 2 and 3, a platform mounting means 16 mounts one side of platform 14 pivotally to base 12. Platform mounting means 16 includes a bracket 18 at each side which is securely mounted to platform 14 by screws 20. Beneath each bracket 18 is a bracket 22 which is securely bolted to base 12. A bolt 24 passes through the overlapping portions of adjacent brackets 18 and 22 to serve as a pivot axle. At the other corners of platform 14, a supporting rod 26 is provided which is secured to platform 14 by a suitable bolt 28. Lower ends 30 of supporting rods 26 are designed to rest against base 12 at which time platform 14 is located parallel to base 12.

For convenience, a holding means 32 is provided for holding platform 14 at a slight angle to base 12 in order to raise supporting rods 26 above and out of contact with base 12. Holding means 32 includes a stop lever 34 which is pivotally attached to bracket 22 by a suitable screw 36. An upper end 38 of stop lever 34 is designed to engage a stop member 40 which is conveniently a screw 42 mounted in bracket 18 at an appropriate height. In order that stop lever 34 engage stop member 40 each time platform 14 is raised, a biasing means 44 is provided. Biasing means 44 includes a spring 46 which is tensioned between a screw 48 attached to stop lever 34 and a screw 50 attached to bracket 18.

As shown best in FIG. 3, when platform 14 is raised (dotted lines), stop lever 34 automatically is pulled beneath stop member 40 by biasing means 32. When it is desired to lower platform 14, stop lever 34 is merely pushed against the force of spring 46 so that upper end 38 clears stop member 40 as platform 14 is lowered. It should be appreciated that stop lever 34 is preferably L-shaped so that the lower part of the "L" engages bracket 18 when platform 14 is raised to prevent upper end 38 of stop lever 34 from being pulled past stop member 40 by spring 46 when platform 14 is raised. Thus, stop lever 34 is automatically positioned for upper end 38 to engage stop member 40 whenever platform 14 is raised.

Circular mat cutting apparatus 10 includes a cutting means 52 which is used for cutting the mat. Cutting means 52 includes a disc member 54 and a disc mounting means 56 for mounting disc member 54 in a large aperture 58 provided in platform 14. As shown, a space 60 is provided between disc member 54 and platform 14. Disc mounting means 56 includes four top bridging members 62. Top bridging members 62 are preferably secured to disc member 54 by screws 64 and extend across space 60 to platform 14. Preferably, a low friction surface is provided below the portion of top bridging members 62 which contacts platform 14, such as a strip of felt. In order to precisely located disc member 54 in the center of aperture 58 with little play, each top bridging member 62 also includes a low friction member 66 such as a short cylindrical metal rod which is screw fit into respective top bridging member 62.

In this preferred embodiment, bottom bridging members 68 are secured below a respective top bridging members 62 by use of the same screw 64. While top bridging members 62 serve to support disc member 54 on platform 14 as disc member 54 is held by gravity, bottom bridging members 68 serve to prevent the upward movement of disc member 54 out of the plane of platform 14. For convience, in rotating disc member 54 relative to platform 14, handles 70 are screw fit into respective top bridging member 62 as shown.

With disc mounting means 56, disc member 54 rotates about a center axis 72. As will be explained subsequently, the rotational position of disc member 54 is of critical importance, and this is the reason that disc mounting means 56 must be constructed to provide a highly accurate and yet free rotational movement of disc member 54. In order to properly position disc member 54, one of top bridging member 62 includes an indicator 74 in the form of an arrow. Then, surrounding disc member 54 is various indicia to which indicator 74 is appropriately aligned.

In order to exactly position disc member 54 in place and to hold disc member 54 in place, a suitable disc locking means 78 is provided. Disc locking means 78 includes two apertures 80 provided in top bridging member 62 and bottom bridging member 68 adjacent indicator 74 and two circumferential rows of holes 82 provided in platform 14. The two rows of holes 82 underlie the respective two apertures 80 provided adjacent indicator 74 as disc member 54 is rotated. Finally, a removable pin 84 is provided which is inserted through one of apertures 80 and a corresponding hole 82 located therebeneath with a close fit. With pin 84 in place, disc member 54 is locked in a rotational position about center axis 72 with no play.

Indicia 76 indicates a plurality of evenly spaced positions available about center axis 72. In the depicted embodiment in FIG. 1, the plurality of evenly spaced positions runs from three consecutively up to sixteen. It should be appreciated that certain numbers have been omitted where that number is a multiple of previous numbers. Thus, for 16 places, indicator 74 is moved to the positions indicated by the numbers 16, as well as the positions indicated by numbers 8 and 4.

Cutting means 52 also includes a crank mechanism 86. Crank mechanism 86 includes a cramk arm 88, an axle 90 which extends through disc member 54, and a mounting arm 92 provided below disc member 54. Crank mechanism 86 is mounted to disc member 54 by a crank mounting means 94. Crank mounting means 94 includes an elongate slot 96 provided in disc member 54 which includes center axis 72. Slidably mounted in slot 76 is a bearing member 98. Bearing member 98 includes an aperture therein in which axle 98 is freely received without much play. Thus, it should be appreciated that by suitably attaching crank arm 88 to the top of axle 90 and mounting arm 92 to the bottom of axle 90, mounting arm 92 is simply rotated by a similar rotation of crank 88. To facilitate this rotation, crank arm 88 is provided with a handle 100 at the distal end thereof. It should also be appreciated that mounting arm 92 is biased upwardly against axle 90 by a resilient biasing means 102, such as a spring 104 located between crank arm 88 and bearing member 98. Thus, mounting arm 92 is not only rotatable by rotation of crank arm 88, but is lowerable relative to base 12 by a downward force exerted on crank arm 88 (the purpose of which is explained subsequently).

While crank mechanism 86 is slidably mounted in slot 96, during use it is desirable to hold crank mechanism 86 in a particular location in slot 96. For that reason, a crank locking means 106 is provided. Crank locking means 106 includes a bottom plate 108 which is located beneath disc member 54 and which spans slot 96. Bottom plate 108 is raisable up into engagement with disc member 54 by means of a screw 110 extending through bearing member 98 as shown. Thus, when screw 110 is tightened, bottom plate 108 frictionally engages disc member 54 to hold bearing member 98 and hence holds crank mechanism 86 in place along slot 96.

As will be appreciated subsequently, it is desired to accurately locate the center of axle 90 from center axis 72. For this reason, an axle indicating means 112 is provided. Axle indicating means 112 includes an indicator 114 mounted on bearing member 98. Located adjacent indicator 104 and parallel to slot 96 is indicia 116. It should be appreciated that when indicator 114 is opposite the "0" indicia, the center of axle 90 coincides with center axis 72. Conveniently, indicia 116 indicates the distance of axle 90 from center axis 72 in inches or some other scale as appropriate.

Circular mat cutting apparatus 10 cuts a mat 118 located on base 12 by means of a cutting blade 120. Cutting blade 120 is adjustably mounted to mounting arm 92 of crank mechanism 86 by a blade mounting means 122. Blade mounting means 122 includes a slide member 124 which is slidably mounted along mounting arm 92. Conveniently, a blade locking means 126 is provided for releasably locking slide member 124 is a selected position along mounting arm 92. In this embodiment, blade locking means 126 is a screw having a narrow handle 128.

As shown in FIG. 2, slide member 124 includes a receiving means 130 in the form of a protruding cylinder having a central aperture therein. Received and bottomed out in the aperture of receiving means 130 is a rod 132. Rod 132 has only a slightly smaller diameter than the aperture in receiving means 130 so that rod 132 is closely fit but rotatable in receiving means 130. In order to hold rod 132 in receiving means 130, a spring member 134 pushes radially against rod 132 so that rod 132 is frictionally held in place. Spring member 134 is part of a wound spring 135 located about receiving means 130 as shown.

At the lower end of rod 132 is a blade holding means 136. Blade holding means 136 is suitably attached to rod 132 and includes a pressing member 138 which is threadably mounted on blade holding means 136 so that cutting blade 120 is located between pressing member 138 and blade holding means 136 and is thus held in place at an angle to mat 118. Due to the rotatable mounting of rod 132 in receiving means 130, the tip of cutting blade 120 tracks behind the center of rod 132 as mounting arm 92 is rotated and cutting blade 120 engages mat 118. The distance between the center of axle 90 and the center of rod 132 thus determines the radius of the circle or arc which is cut in mat 118. In order to select a desired radius, a balde indicating means 140 is provided. Blade indicating means 140 includes an indicator 142 provided on slide member 124 and suitable indicia 144 provided on mounting arm 92. Preferably, indicia 144 is calibrated to show diameter in inches rather than radius.

In order to properly position mat 118 on base 12 relative to center axis 72, a base indicating means 146 is provided. Base indicating means 146 includes a first rule member 148 which is suitably mounted by screws 150 to a bracket 152 attached to base 12 by screws 154. As shown in FIG. 1, there is a space 156 provided between first rule member 148 and base 12. First rule member 148 is provided with suitable indicia 158 which indicates a distance in a first direction from center axis 72.

Movably mounted on first rule member 148 is a second rule member 160. Second rule member 160 is slidably mounted to first rule member 148 by a rule mounting means 162. As shown, rule mounting means 162 includes a slide member 164 and a lock means 166 for locking slide member 164 in position along first rule member 148. Rule mounting means 166 mounts second rule member 160 perpendicular to first rule member 148. Second rule member 160 is provided with indicia 168 as shown in FIG. 1. This indicia indicates a distance in a second direction from center axis 72.

Provided along second rule member 160 is a stop member 170. Stop member 170 is slidably mounted on second rule member 160 and is suitably held in place by a lock means 172. As shown, mat 118 is centered relative to center axis 72, with one side of mat 118, resting against second rule member 160 and the other side against stop member 170. It should be appreciated that indicia 158 provided along first rule member 148 is designed to be read off of the side of slide member 164 so that the "0" is slightly offset from center axis 72, accounting for the extra thickness of slide member 164 relative to second rule member 160 as shown.

As mentioned above, holding means 32 serves to hold platform 14 in a raised position where mat 118 can be inserted or removed from base 12. When it is desired to cut mat 118 using cutting blade 120, platform 14 is lowered as holding means 32 is disengaged. At this time, it is desired to hold mat 118 firmly in place on base 12. For this reason, circular mat cutting apparatus 10 is further provided with a mat holding means 174. Mat holding means 174 includes a pair of pads 176. Pads 176 are suitably formed by metal angle members 178 having a rubber coating or the like on the portion which engages mat 118. Pads 176 are mounted to platform 14 by a suitable pad mounting means 180. Pad mounting means 180 includes a rod 182 attached to pad 176 and extending parallel to base 12. Rods 182 are slidably received in an aperture 184 provided in the lower end of respective supporting rods 26. Thus, it will be appreciated that by movement of rods 182 in aperture 184, the location of pads 176 can be adjusted radially relative to center axis 72. In addition, by mounting supporting rosa 26 for rotation in platform 14, the angular relationship of each pad 176 relative to center axis 72 can also be adjusted as desired.

For convenience, in a preferred embodiment, both platform 14 and disc member 54 are made of a transparent plastic material. In addition, to provide a smooth movement, it is also preferred that top bridging member 62, bottom bridging member 68, bearing member 98, and slide member 124 be made of brass or another suitable metal.

In operation, circular mat cutting apparatus 10 functions in the following manner. Intially, the location on mat 118 about which the circles or arcs are to be centered is determined. Typically, the center of mat 118 is chosen. In this case, slide member 164 is moved until the right hand side is adjacent indicia 158 indicating half of the length of that side of mat 118 and lock means 156 locked in place. Then, stop member 170 is moved to a position where the upper or inside of stop member 170 registers adjacent indicia 168 indicating half of the width of mat 118. With platform 14 in the raised position, it is then a simple matter to slip mat 118 into position with the width side flush against second rule member 160 and the adjacent side engaging stop member 170. In this position, the center of mat 118 coincides with center axis 172.

Figure 4:
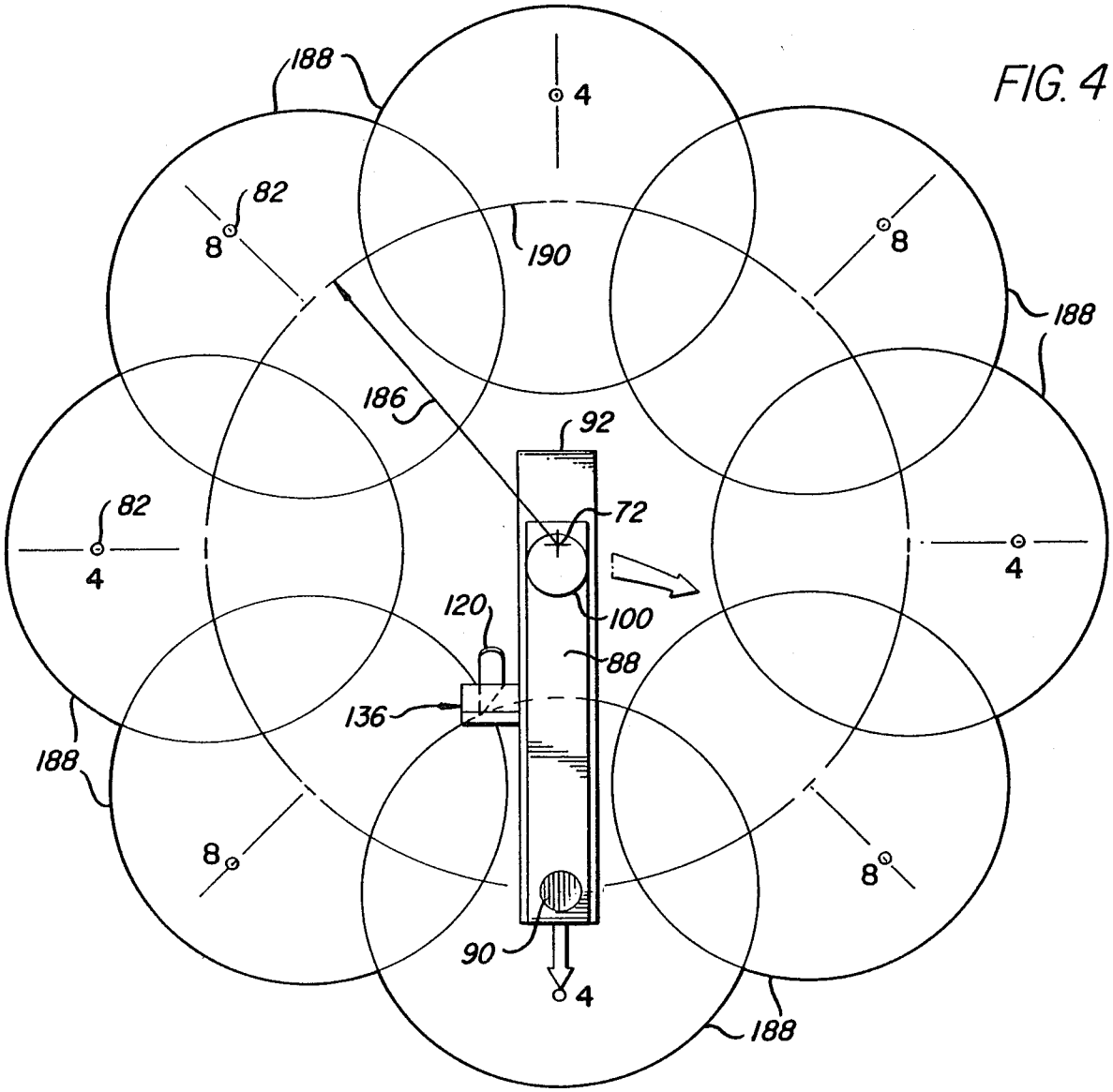
FIG. 4 is a schematic top view of a plurality of circles cut with the mat cutting apparatus of the present invention.

With mat 118 in place on base 12, it is then necessary to determine how far out from center axis 72 the centers of the rings of circles to be cut should be located. With reference to FIG. 4, this distance is the radius 186 shown for the circles 188 to be cut. The circles are located about a circular center line 190. The radius 186 is determined by use of axle indicating means 112, as the center of circular center line 190 always coincides with the center of axle 90. As shown in FIG. 1, the distance of radius 186 is 2.75 inches. With the location of circular center line 190 determined, the radius or diameter of the circles 188 to be cut must be determined. This is determined by use of blade indicating means 140. The radius or diameter of the circles 188 is determined by the location of slide member 124 along mounting arm 92, as indicated by indicia 144 and indicator 142.

With the above measurements determined, it must also be determined how many circles 188 are to be cut. In FIG. 4, eight such circles 188 are cut. This is done by selectively moving disc member 54 until indicator 74 is opposite indicia 76 showing a "4" or "8". At each of these locations, pin 84 is inserted through one of the two apertures 80 provided in top bridging member 62 and the underlying hole 82 provided in disc member 54. Each time this is done, to lock disc member 54 in place, crank arm 88 is grasped by handle 100 and pushed downwardly until cutting blade 120 begins to engage mat 118. Crank arm 88 is then rotated, causing cutting blade 120 to be similarly rotated.

It should be noted that cutting blade 120 may not be exactly aligned upon the line for circle 188 to be cut when cutting blade 120 intially engages mat 118. However, as cutting blade 120 is rotatably mounted by rod 132 to receiving means 130, cutting blade 120 is quickly aligned immediately behind rod 132 as cutting blade 120 is pulled through mat 118. Thus, by making two or three revolutions with handle 100 as handle 100 is further pushed down to finally push cutting blade 120 completely through may 118, a smooth and accurate circle 188 is cut. Handle 100 is then released and resilient biasing means 102 causes crank arm 88 to be pushed upward from disc member 54 and thus to cause cutting blade 120 to disengage mat 118. Pin 84 is then removed from hole 82 in platform 14, and disc member 54 is rotated to the next "4" or "8" of indicia 76 and a new circle 188 is cut.

Figure 5:
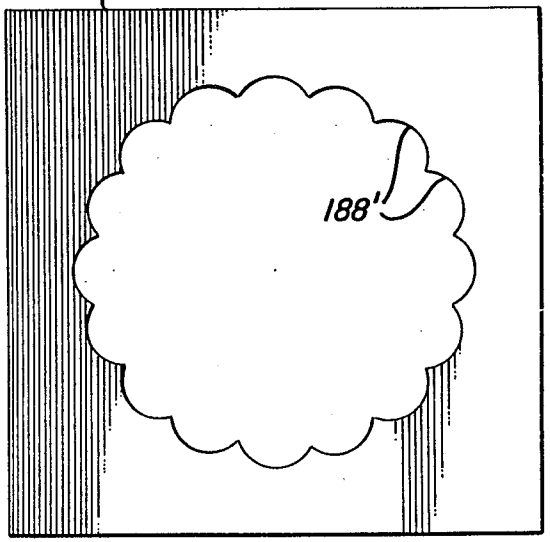
FIG. 5 is a top plan view of a mat cut according to the present invention.

It should be appreciated that in FIG. 4, circles 188 overlap. Depiced in FIGS. 5 is a finished mat 118' in which sixteen circles were cut using circular mat cutting apparatus 10. As shown, mat 118' thus includes a series of sixteen arcs 188'. It should also be appreciated that the angle mounting of cutting blade 120 results in arcs 188' all having an inwardly angled edge typically preferred in the art.

When all of the circles 188 have been cut in mat 118, platform 14 is raised slightly in order to engage stop lever 34 below stop member 40. This position of platform 14 is depicted in FIG. 3 in dashed lines. As shown, this also causes pads 176 to be raised above mat 118. Thus, it is then a simple matter to remove mat 118. Circular mat cutting apparatus 10 is then ready to cut a new mat 118 of the same configuration, or to be adjusted for new mats having different size circles 188, radiuses of 186 of circles 188, different number of circles, and different size mats or different placements on the mats.

It should also be appeciated the locations of pads 176 are adjustable in order to make sure that pads 176 do not interfere with the cutting of any circles 188.

While the present invention has been described with respect to an exemplary embodiment thereof, it will be understood by those of ordinary skill in the art that variations and modifications can be effected with the scope and spirit of the invention.

I claim:

1. An apparatus for cutting circular arcs or holes in a picture mat comprising:

a flat base upon which the mat rests;

a platform provided above said base; and a cutting means for cutting the mat including a disc member, a disc mounting means for mounting said disc member for rotation adjacent said platform about a center axis, a disc locking means for releasably locking said disc member against rotation about the center axis, a crank mechanism having an axle extending perpendicularly through said disc member and a mounting arm attached to and extending perpendicular from a bottom end of said axle below said disc member, a crank mounting means for slidably mounting and releasably locking said crank mechanism to said disc member at a selected one of a plurality of positions along a radial path through the center axis, a cutting blade, a blade mounting means for adjustably mounting said cutting blade along said mounting arm and at a cutting angle to the mat;

whereby the circle or arc is cut in the mat by rotation of said crank mechanism, at a location determined by the position of said crank mounting means and said disc mounting means, and with a diameter determined by the position of said blade mounting means.

2. An apparatus for cutting a mat as claimed in claim 1 and further including spacing indicia provided on said platform about said disc member and an indicator on said disc member which is selectively alignable with said indicia whereby a selected plurality of evenly-spaced circles are cut in the mat about the center axis by making a cut each time said indicator is selectively spaced in alignment with corresponding indicia by rotation of said disc member.

3. An apparatus for cutting a mat as claimed in claim 2 wherein said disc mounting means mounts said disc member in a plane of said platform, wherein said indicator extends from said disc member and over said platform and includes an aperture therein, and wherein said disc locking means includes a plurality of holes in said disc member at preselected positions adjacent said indicia and a pin which is inserted through the aperture in said indicator and one of said holes to lock said disc member in place

4. An apparatus for cutting a mat as claimed in claim 3 wherein said disc mounting means includes at least three bridging members which are attached to a top of said disc member and which rest against a top of said platform to support said disc member relative to said platform, wherein there is a space between said disc member and said platform and a low friction member is provided on each said bridging member which extends into this space to provide a smooth and substantially play-free rotation of said disc member, and wherein one of said bridging members serves as said indicator.

5. An apparatus for cutting a mat as claimed in claim 2 and further including an axle indicating means for indicating the distance of said axle from the center axis.

6. An apparatus for cutting a mat as claimed in claim 5 wherein said crank mounting means includes a slot provided in said disc member, a bearing member which slides in said slot and in which said axle is rotatably mounted, and a crank locking means for locking said bearing member in a selected position along said slot.

7. An apparatus for cutting a mat as claimed in claim 6 wherein said axle indicating means includes an indicator on said bearing member and indicia adjacent said radial slot on said disc member.

8. An apparatus for cutting a mat as claimed in claim 6 wherein said crank mechanism further includes a resilient biasing means for biasing said axle upwards such that said blade is raised out of engagement with the mat until the operator exerts a force to overcome the biasing means and cause said blade to pierce the mat.

9. An apparatus for cutting a mat as claimed in claim 8 wherein said crank mechanism includes a crank arm attached to a top of said axle; and wherein said resilient biasing means includes a sliding mounting in said bearing member for said axle and a spring located between said crank arm and said bearing member.

10. An apparatus for cutting a mat as claimed in claim 5 wherein said blade mounting means further includes a blade indicating means for indicating a distance between a center of said axle and said cutting blade whereby the diameter or radius of the circle to be cut is indicated.

11. An apparatus for cutting a mat as claimed in claim 10 wherein said blade mounting means includes a slide member which slides along said mounting arm; and wherein said blade indicating means includes indicia located along said mounting arm and an indicator on said slide member.

12. An apparatus for cutting a mat as claimed in claim 11 wherein said blade mounting means includes a blade locking means for selectively locking said slide member in position along said mounting arm.

13. An apparatus for cutting a mat as claimed in claim 10 and further including a base indicating means for indicating a position from the center axis along two perpendicular directions in a plane of said base whereby the mat is easily positioned relative to the center axis.

14. An apparatus for cutting a mat as claimed in claim 13 wherein said base indicating means includes a first rule member on said base, a second rule member, and a rule mounting means for slidably mounting said second rule member perpendicular to said first rule member.

15. An apparatus for cutting a mat as claimed in claim 14 wherein said rule mounting means includes a lock means for locking said second rule member in position relative to said first rule member and further including a stop member movably mounted on said second rule member.

16. An apparatus for cutting a mat as claimed in claim 13 wherein said blade mounting means includes a blade holding means for holding said cutting blade thereto, a rod to which said blade holding means is attached such that said cutting blade is offset from said rod, and receiving means for removably receiving said rod and for allowing free rotation of said rod during cutting.

17. An apparatus for cutting a mat as claimed in claim 16 and further including a platform mounting means for mounting a side of said platform pivotally to a side of said base whereby said platform is easily moved between a non-working raised position away from said base and a working lowered position adjacent said base, and wherein said platform mounting means includes a holding means for holding said platform in the raised position.

18. An apparatus for cutting a mat as claimed in claim 17 and further including a mat holding means attached to said platform for holding the mat against said base when said platform is in the lowered position and which disengages the mat when said platform is in the raised position.

19. An apparatus for cutting a mat as claimed in claim 1 and further including a platform mounting means for mounting a side of said platform pivotally to a side of said base whereby said platform is easily moved between a non-working raised position away from said base and a working lowered position adjacent said base.

20. An apparatus for cutting a mat as claimed in claim 19 wherein said platform mounting means includes a holding means for holding said platform in the raised position.

21. An apparatus for cutting a mat as claimed in claim 20 wherein said holding means includes a stop member provided adjacent one of said platform and said base, a stop lever pivotally mounted to the other of said platform and said base, and a biasing means for biasing said stop lever into position to engage said stop member and hold said platform in the raised position when said platform is raised.

22. An apparatus for cutting a mat as claimed in claim 20 and further including a mat holding means attached to said platform for holding the mat against said base when said platform is in the lowered position and which disengages the mat when said platform is in the raised position.

23. An apparatus for cutting a mat as claimed in claim 22 wherein said mat holding means includes two pads and a respective pad mounting means for each said pad for mounting said respective pad for adjustable movement radially and angularly with respect to the center axis.

24. An apparatus for cutting a mat as claimed in claim 1 wherein said disc member is made of a transparent material.

25. An apparatus for cutting a mat as claimed in claim 24 wherein said platform is made of a transparent material.

* * * * *